US011242224B2

(12) United States Patent
Kashiwakura

(10) Patent No.: US 11,242,224 B2
(45) Date of Patent: Feb. 8, 2022

(54) ELEVATOR DOOR DEVICE

(71) Applicant: FUJITEC CO., LTD., Hikone (JP)

(72) Inventor: Hiroshi Kashiwakura, Hikone (JP)

(73) Assignee: FUJITEC CO., LTD., Shiga (JP)

( * ) Notice: Subject to any disclaimer, the term of this patent is extended or adjusted under 35 U.S.C. 154(b) by 380 days.

(21) Appl. No.: 16/558,764

(22) Filed: Sep. 3, 2019

(65) Prior Publication Data

US 2020/0115191 A1 Apr. 16, 2020

(30) Foreign Application Priority Data

Oct. 12, 2018 (JP) ..... JP2018-193614

(51) Int. Cl.
*B66B 13/12* (2006.01)
*B66B 13/16* (2006.01)
*B66B 13/08* (2006.01)

(52) U.S. Cl.
CPC ..... *B66B 13/12* (2013.01); *B66B 13/08* (2013.01); *B66B 13/16* (2013.01)

(58) Field of Classification Search
CPC ..... B66B 13/08; B66B 13/12; B66B 13/16; B66B 13/165; B66B 13/18; B66B 13/185
See application file for complete search history.

(56) References Cited

U.S. PATENT DOCUMENTS 1,411,770 A * 4/1922 Bleyle ..... B66B 13/16 187/280
5,005,673 A * 4/1991 Rivera ..... B66B 13/12 187/319
5,690,188 A * 11/1997 Takakusaki ..... B66B 13/12 187/319
5,730,254 A * 3/1998 Nguyen ..... B66B 13/12 187/325
6,220,396 B1 * 4/2001 Heath, III ..... B66B 13/20 187/319

FOREIGN PATENT DOCUMENTS

| | | | | |
|---|---|---|---|---|
| CN | 105645239 A | * | 6/2016 | |
| CN | 106429761 A | * | 2/2017 | |
| CN | 109230965 A | * | 1/2019 | |
| GB | 2295814 A | * | 6/1996 | B66B 13/165 |
| JP | 1143276 A | | 2/1999 | |
| JP | 201516949 A | | 1/2015 | |
| KR | 20110026556 A | * | 3/2011 | |
| KR | 101772119 B1 | * | 8/2017 | |
| WO | WO-2020179911 A1 | * | 9/2020 | B66B 13/12 |

* cited by examiner

*Primary Examiner* — Minh Truong
(74) *Attorney, Agent, or Firm* — The Webb Law Firm

(57) ABSTRACT

Provided is an elevator door device including: a rail that is disposed above an entrance; an opening and closing part of the entrance; and a locking mechanism that locks the opening and closing part. The locking mechanism includes: an engaging part including an engaging body that changes its position between a releasing position and an engaging position in association with the opening and closing of the opening and closing part; and an engaged part including an engaged body engaged with the engaging body at the engaging position. The engaged part is disposed in an area between the rail and the entrance, and overlaps with the rail as seen in plan view in the area. The opening and closing part has such a shape as to be able to open and close without abutting on the engaged part.

4 Claims, 8 Drawing Sheets

ELEVATOR DOOR DEVICE

CROSS-REFERENCE TO RELATED APPLICATION

This application claims priority to Japanese Patent Application No. 2018-193614 filed Oct. 12, 2018, the disclosure of which is hereby incorporated by reference in its entirety.

FIELD

The present invention relates to an elevator door device that includes a locking mechanism that can lock an opening and closing part that opens and closes a car entrance or a landing entrance.

BACKGROUND

Conventionally, there is known an elevator door device including a car door lock (see JP 2015-16949 A). This elevator door device includes a door that opens and closes the car entrance, a rail that is positioned above the entrance and extends in the width direction of the entrance, a door hanger that allows the door to reciprocate along the rail while hanging down therefrom, and a locking mechanism that locks the door.

The locking mechanism includes an operating body that changes the position from the releasing position to the engaging position or vice versa in association with the opening and closing of the door, and a fixing piece that engages with the operating body that has comes into the engaging position by the closing of the door. The respective components of the locking mechanism are disposed on the front (landing side) of the rail.

According to this elevator door device, with the door held in the closed state, the operating piece at the engaging position engages with the fixing piece to lock the door, and therefore the door is not opened even if the door is forcedly opened by a user or the like inside the car, for example, when the elevator stops between the floors. On the other hand, when the door is to be opened, the fixing part is released from engagement with the operating body that has come into the releasing position by the opening of the door to thereby unlock the door.

In the aforementioned elevator door device, all the components of the locking mechanism are disposed on the front side (landing side) of the rail that guides the door hanger, and therefore the locking mechanism projection amount in the elevator door device toward the landing side (the projection amount from the car body) is large. However, there is a case where the elevator door device is required to be designed with a small projection amount toward the landing side due to a small distance between the car and the landing floor according to the specifications of the elevator or the structure of the building in which the elevator is installed.

SUMMARY

Therefore, it is an object of the present invention to provide an elevator door device that enables a small projection amount from the car toward the landing floor or from the landing floor toward the car.

For improving the basic understanding on the some features of the invention of the present application, a brief summary of the present invention will be described below. This summary does not show the outline of the present invention, and is not intended to specify the main or important features of the present invention or to limit the scope of the present invention. The purpose thereof is only to provide some of basic concepts of the invention in a simplified style as a premise of the subsequent detailed description of the invention.

An elevator door device of the present invention includes:

a rail that is disposed above a car entrance or a landing entrance and extends in a width direction of the entrance;

an opening and closing part that includes a door, and a door hanger that allows the door to reciprocate along the rail while allowing the door to directly or indirectly hang down therefrom, and that opens and closes the entrance; and a locking mechanism that locks the opening and closing part, the locking mechanism including:

an engaging part that includes an engaging body that changes its position between a releasing position and an engaging position in association with the opening and closing of the opening and closing part; and an engaged part that includes an engaged body configured to be engaged with the engaging body that has come into the engaging position by the closing of the opening and closing part, wherein at least part of the engaged part being disposed in an area between the rail and an upper end of the entrance, and overlaps with the rail as seen in plan view in the area, and wherein the opening and closing part having such a shape as to be able to open and close without abutting on the at least part of the engaged part located in the area.

According to this configuration, the at least part of the engaged part is located in the area under the rail so that the projection amount from the car toward the landing floor or from the landing floor toward the car can be reduced compared with the case where all the components of the locking mechanism are disposed on the front side of the rail.

The elevator door device may be configured so that the opening and closing part includes two opening and closing parts that are disposed to be able to move toward and away from each other in the width direction, each of the two opening and closing parts includes a connecting member disposed between the door and the door hanger to connect the door with the door hanger, and the at least part of the engaged part in the area is located between the connecting members of the two opening and closing parts.

Even in such a configuration that the connecting members are disposed between the door and the door hanger, the projection amount from the car toward the landing floor or from the landing floor toward the car can be reduced by locating the at least part of the engaged part in the area under the rail.

The engaged body of the elevator door device may be disposed under the rail.

The engaged part of the elevator door device may include a supporting member that extends from a front side of the rail to the engaged body and supports the engaged body, and a rotation stopping member that prevents rotation of the supporting member.

The engaged body of the elevator door device may extend in the opening and closing direction of the opening and closing part, and has a distal end bent upward to be engageable with the engaging part.

The supporting member of the elevator door device may include a plate-shaped part located between a point to which the rail is connected and a point to which the engaged body is connected, the plate-shaped part extending downward and expanding in the plane direction including the vertical direction and the opening and closing direction.

The rotation stop member of the elevator door device may include a first part that is attached to a rear side of the plate-shaped part of the supporting member on a side close to the rail, and a second part that extends from the first part toward the rail and abuts on the lower end of the rail, wherein a part of the engaged part may be the second part.

BRIEF DESCRIPTION OF DRAWINGS

The aforementioned features and the other features of the present invention will be clarified by the following description and figures illustrating the embodiments of the present invention.

DESCRIPTION OF EMBODIMENTS

Hereinafter, one embodiment according to the present invention will be described with reference to FIG. 1 to FIG. 8.

Figure 1:
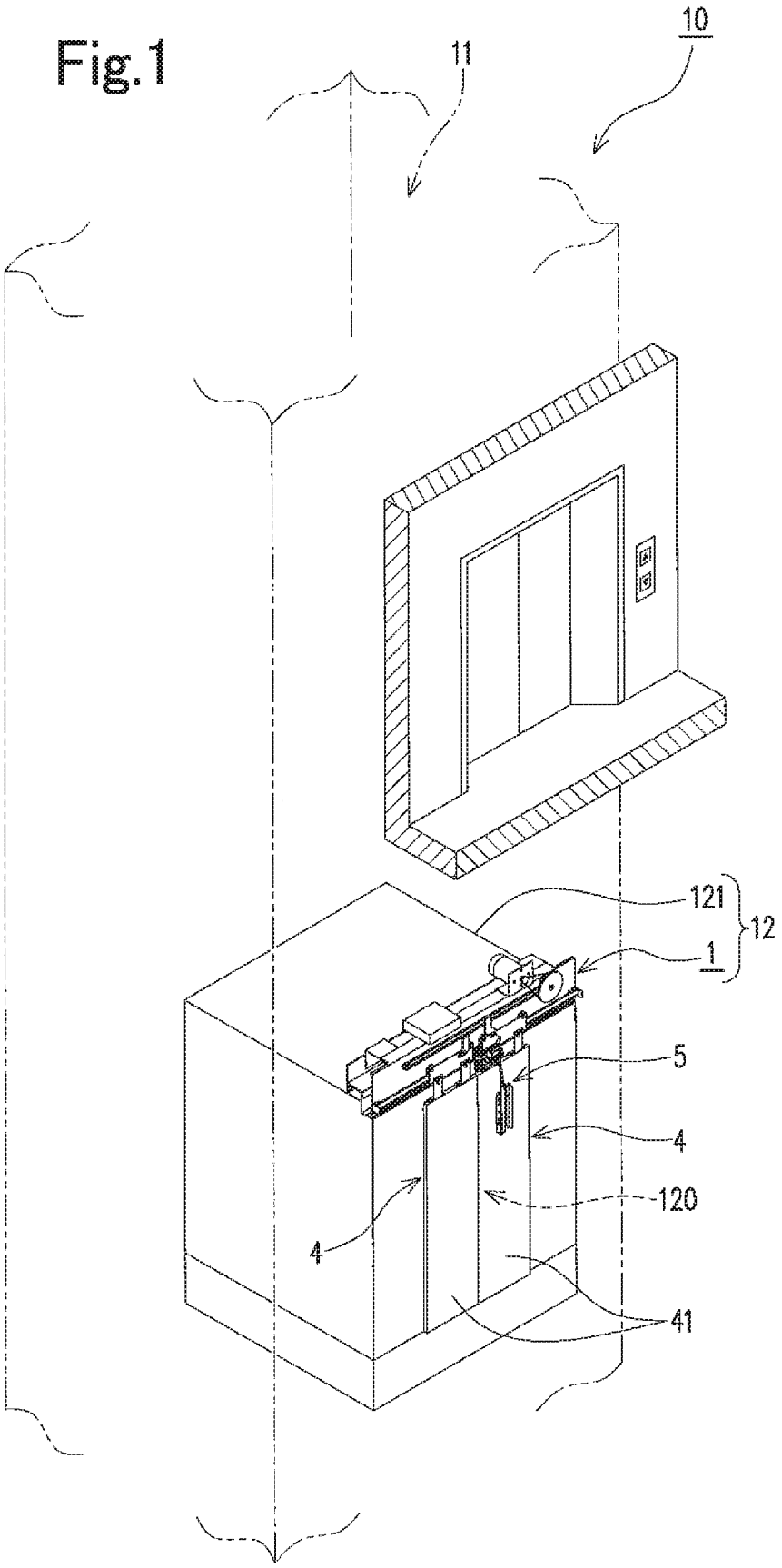
FIG. 1 is an explanatory diagram for the configuration of an elevator according to the present embodiment.

As shown in FIG. 1, in an elevator 10 that includes a shaft 11 that extends in the vertical direction throughout a plurality of floors in a building, a car 12 that vertically moves within the shaft 11, an elevator door device (hereinafter also referred to as only "door device") according to this embodiment is configured to open and close an entrance 120 of the car 12. The car 12 includes a car body 121 having the entrance 120, and a door device 1 that is disposed in the car body 121 to open and close the entrance 120.

Figure 2:
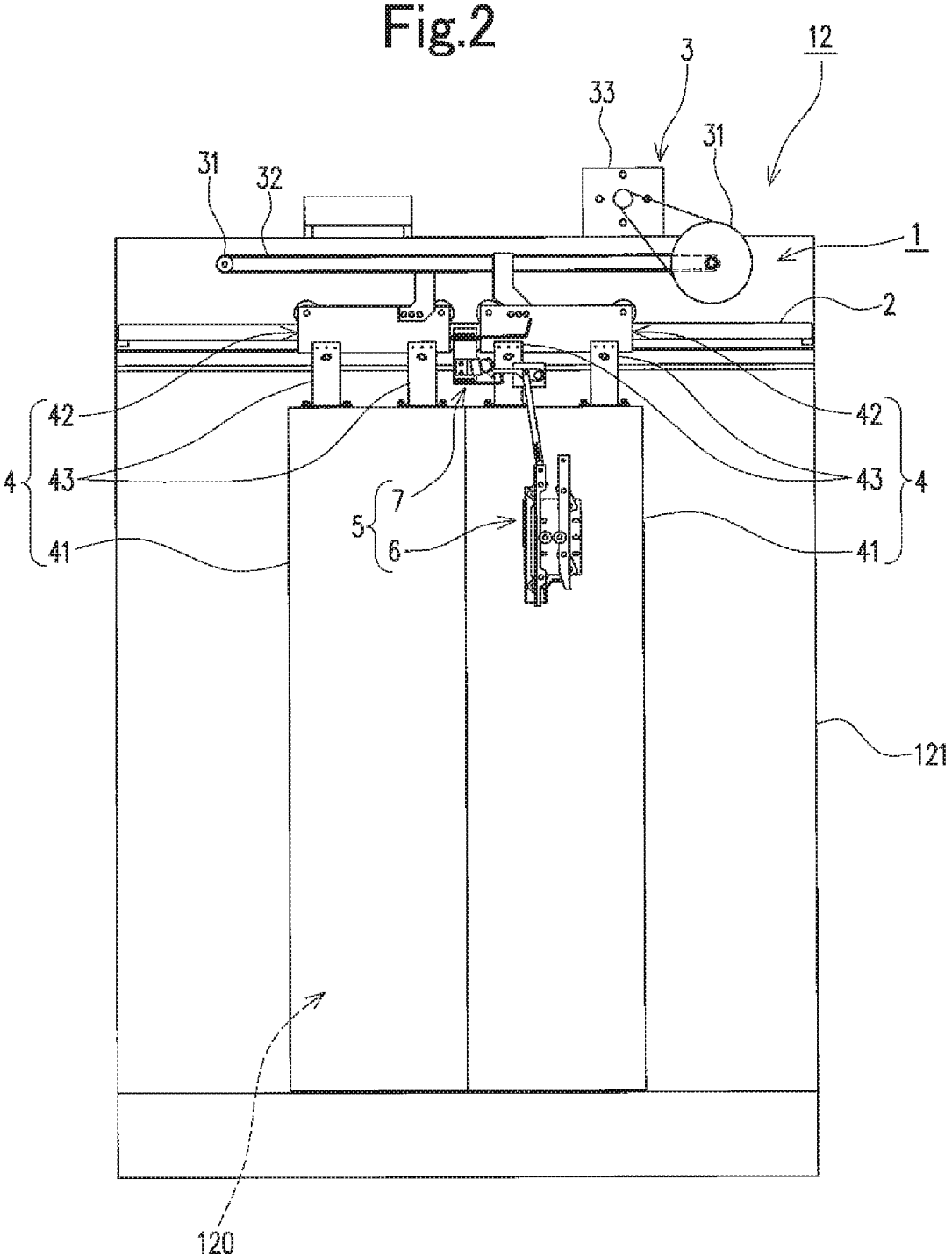
FIG. 2 is a front view of a car of the elevator.
Figure 3:
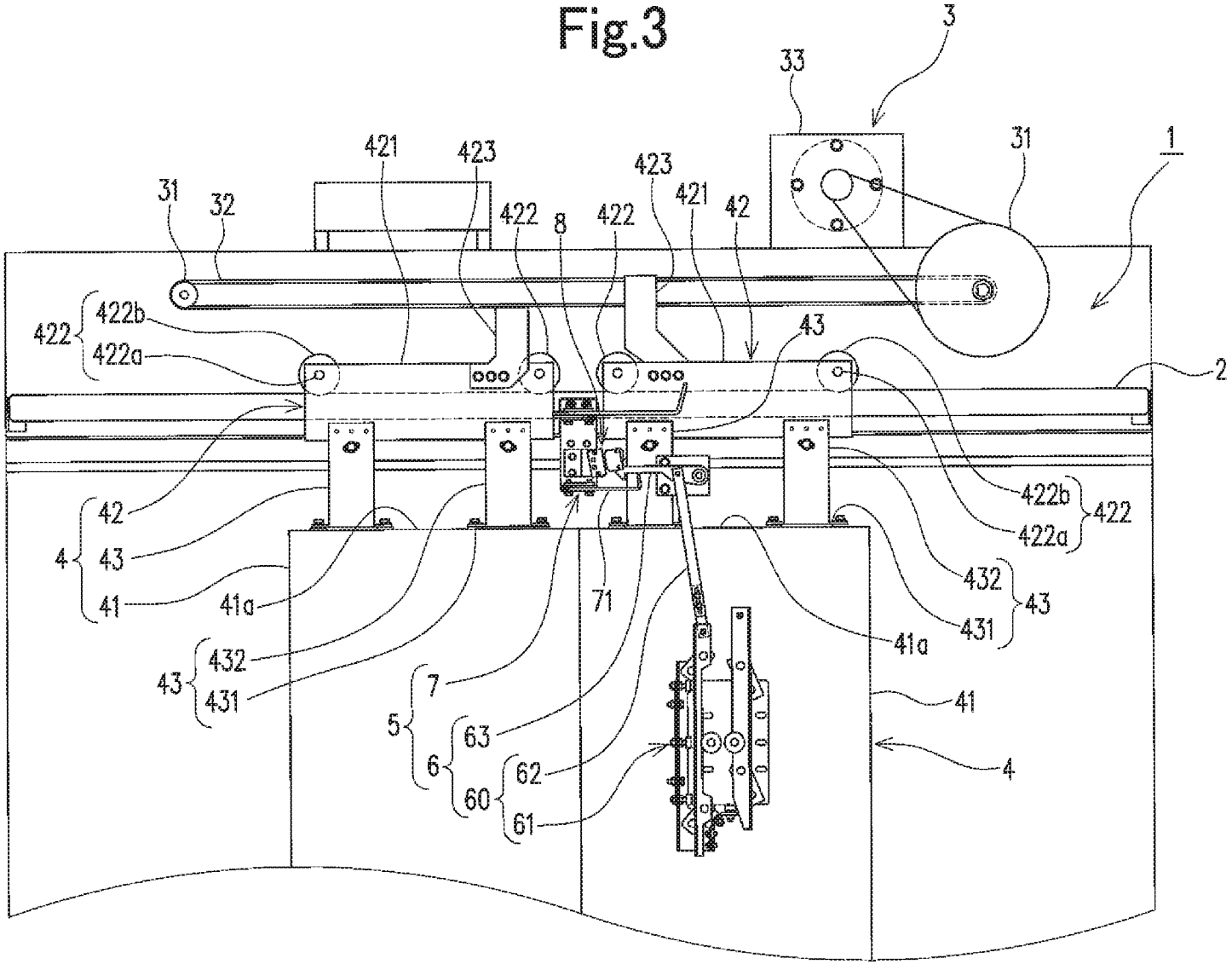
FIG. 3 is an enlarged view of an engaging part, an engaged part of the elevator door device, and their periphery.

The door device 1 includes, as shown in FIG. 2 and FIG. 3, a guide rail (or rail) 2 that extends in the width direction (the left-right direction in FIG. 2: hereinafter also referred to as "the opening and closing direction") of the entrance 120 above the entrance 120 of the car 12, an opening and closing part 4 that opens and closes the entrance 120, and a locking mechanism 5 that can lock the opening and closing part 4. The door device 1 further includes a driving device 3 or the like that moves the opening and closing part 4 in the opening and closing direction. The door device 1 of this embodiment is a so-called center open type door device and includes two opening and closing parts 4 that can move toward and away from each other in the opening and closing direction.

The guide rail 2 is disposed above the entrance 120 of the car body 121 and extends in the opening and closing direction to guide the opening and closing parts 4.

The driving device 3 is disposed on the car body 121 and drives the opening and closing parts 4 directly or indirectly. The driving device 3 includes a pair of pulleys 31 that are disposed at an interval in the opening and direction above the guide rail 2, an endless annular belt body 32 that is wound around the pair of pulleys 31, and a motor 33 that rotatingly drives one of the pair of pulleys 31.

Each of the two opening and closing parts 4 has such a shape as to be able to open and close without abutting on the engaged part 7 (see FIG. 6 and FIG. 7) of the locking mechanism 5. Specifically, each of the opening and closing parts 4 includes a door 41 having a vertically elongated rectangular shape, and a door hanger 42 that allows the door to reciprocate along the guide rail 2 while allowing the door to directly or indirectly hang down from the door hanger 42. Each of the opening and closing part 4 of this embodiment further includes a connecting member 43 that is disposed between the door 41 and the door hanger 42 to connect the door 41 with the door hanger 42. That is, the door hanger 42 allows the door 42 to hang down (indirectly) therefrom via the connecting member 43. Also, each of the opening and closing parts 4 of this embodiment is connected by two connecting members 43.

The door hanger 42 includes a plate-shaped main body 421 expanding along the plane direction including the vertical direction and the opening and closing direction, a guided part 422 that is attached to the main body 421 to be guided to the guide rail 2, and a coupling member 423 that couples the main body 421 with a belt body 32 of the driving device 3.

The guided part 422 is a so-called rotary roller and includes a shaft **422*a* that extends from the main body 421, and a roller body 422*b* that is rotatable around the shaft 422*a* as a rotational center. The shaft 422*a* extends in the entrance direction of the passenger (in the direction in which the car 12 opposes the landing floor) of the entrance 120 from the main body 421. The roller body 422*b* has a groove in the outer periphery to allow the guide rail 2** to fit in the groove.

The coupling member 423 has a lower end connected to the main body 421, and an upper end connected to the belt body 32 of the driving device 3. The coupling member 423 of the door hanger 42 in one of the two opening and closing parts 4 (the right one in FIG. 2) is connected to a point positioned on the upper side of the endless annular shaped belt body 32 wound around the pair of pulleys 31. The coupling member 423 of the door hanger 42 in another one of the two opening and closing parts 4 (the left one in FIG. 2) is connected to a point on the lower side of the endless annular shaped belt body 32 wound around the pair of pulleys 31.

The two connecting members 43 are located along the upper end **41*a* of the door 41 at an interval in the opening and closing direction. One of the two connecting members 43 (the connecting member 43 on the door closing side) is located at a position away from an end of the door on the door closing side by a first distance toward the door opening side along the upper end 41*a*. Another one of the two connecting members 43 (the connecting member 43 on the door opening side) is located at a position away from an end of the door on the door opening side by a second distance toward the door closing side along the upper end 41*a*. The first distance is set so that, when the two opening and closing parts 4 (the doors 41) are held in the fully-closed position with the locking mechanism 5 between the two connecting members 43 located on the door closing side, a part of the engaged part 7 of the locking mechanism 5 (specifically, a rotation stopping member 723** to be later described: see FIG.

8) is not allowed to contact any one of these two connecting members 43. The first distance and the second distance are equal to each other in this embodiment.

Each of the two connecting members 43 has a lower end fixed (coupled) to the door hanger 41 and an upper end fixed (coupled) to the door hanger 42 to thereby connect the door 41 with the door hanger 42. Specifically, each of the connecting members 43 includes a fixing part 431 that is fixed to the door 41, and an extending part 432 that extends upward from the fixing part 431. The fixing part 431 is a plate-shaped part extending along the horizontal plane of the lower end of the extending part 432 and is fixed to the upper end of the door 41. The extending part 432 is a rectangular plate-shaped part provided along the plane direction including the vertical direction and the opening and closing direction and has an upper end fixed to the door hanger 42.

The locking mechanism 5 includes an engaging part 6 attached to the opening and closing part 4 and an engaged part 7 attached to the guide rail 2, and is configured to lock the opening and closing parts 4 so as not to be open (specifically, not to be able to move the two opening and closing parts 4 in the separating direction) by the engagement of the engaging part 6 with the engaged part 7. The locking mechanism 5 of this embodiment includes an engaging part 6 that includes an engaging body 63 that changes its position from the releasing position to the engaging position or vice versa in association with the opening and closing of the door, and an engaged part 7 that includes an engaged body 71, with which the engaging body 6 that has come into the engaging position by the closing of the opening and closing parts 4. The engaged body 71 is engaged with the engaging body 63 that has come into the engaging position by the closing of the opening and closing parts 4 to thereby lock the opening and closing parts 4, while the engaged body 71 is released from the engagement with the engaging body 63 that has come into the releasing position by the opening of the opening and closing parts 4 to thereby release the opening and closing parts 4 from the locked state. The locking mechanism 5 of this embodiment also includes a detecting part 8 that can detect the locking state and the unlocking state. A specific configuration of the locking mechanism 5 of this embodiment will be described below.

As shown in FIG. 4 to FIG. 7, the engaging part 6 includes a power transmission part 60 that transmits the power of the driving device 3 to the other members, and an engaging body 63 that is engageable with the engaged body 71 of the engaged part 7. The engaging part 6 of this embodiment is attached to one of the two opening and closing parts 4 (the part on the right side in FIG. 2).

The power transmission part 60 includes a first transmission part 61 that transmits the power of the driving device 3 to the opposing door (the door on the landing side in this embodiment), and a second transmission part 62 that transmits the power of the driving device 3 to the engaging body 63.

The first transmission part 61 is disposed on the door 41. The first transmission part 61 includes a base 610 to fix the first transmission part 61 to the door 41, a pair of holding parts 611, 612 (first holding part 611 and second holding part 612) that hold therebetween catch rollers C provided on the opposing door (see FIG. 4 and FIG. 5), and a restricting member 613 that restricts the movable range of the pair of holding parts 611, 612.

The base 610 includes a base body 6101 that extends along the door 41 and a holding part 6102 that rises (projects) from the base body 6101 to hold the restricting member 613. In the base 610 of this embodiment, a plate-shaped member in a specific form is bent to form the base body 6101 and the holding part 6102.

The first holding part 611 includes a first angle member 6111 that extends in the vertical direction, and a first connecting member 6112 that connects the base 610 with the first angle member 6111. The first holding part 611 of this embodiment includes two first connecting members 6112.

The first angle member 6111 has a first holding surface 6111A that extends in the vertical direction and the entrance direction and faces the door opening side. The first angle member 6111 of this embodiment is a member having an L-shape in the cross section.

The two first connecting members 6112 are disposed at an interval in the vertical direction. Each of the first connecting members 6112 is connected to the base 610 (specifically, the base body 6101) to be relatively rotatable around a shaft S1 extending in the entrance direction, while being connected to the first angle member 6111 to be relatively rotatable around a shaft S2 extending in the entrance direction. Thereby, the first angle member 6111 rotationally moves (pivotally moves) while maintaining its position with the first holding surface 6111A facing a certain direction (the door opening direction). The first connecting member 6112 of this embodiment is a rectangular plate-shaped member.

The second holding part 612 includes a second angle member 6121 that extends in the vertical direction, and a second connecting member 6122 that connects the base 610 with the second angle member 6121. The second holding part 612 of this embodiment includes two second connecting members 6122.

The second angle member 6121 includes a second holding surface 6121A that extends in the vertical direction and the entrance direction and faces the door opening side. The second angle member 6121 of this embodiment is a member having an L-shape in the cross section.

The two second connecting members 6122 are disposed at an interval in the vertical direction. Each of the second connecting members 6122 is connected to the base 610 (specifically, the base body 6101) to be relatively rotatable around a shaft S3 extending in the entrance direction, while being connected to the second angle member 6121 to be relatively rotatable around a shaft S4 extending in the entrance direction, in the same manner as the first connecting members 6112. Thereby, the second connecting member 6122 rotationally moves (pivotally moves) while maintaining its position with the second holding surface 6121A facing a certain direction (the door closing direction). The second angle member 6121 of this embodiment is a rectangular plate-shaped member.

Figure 4:
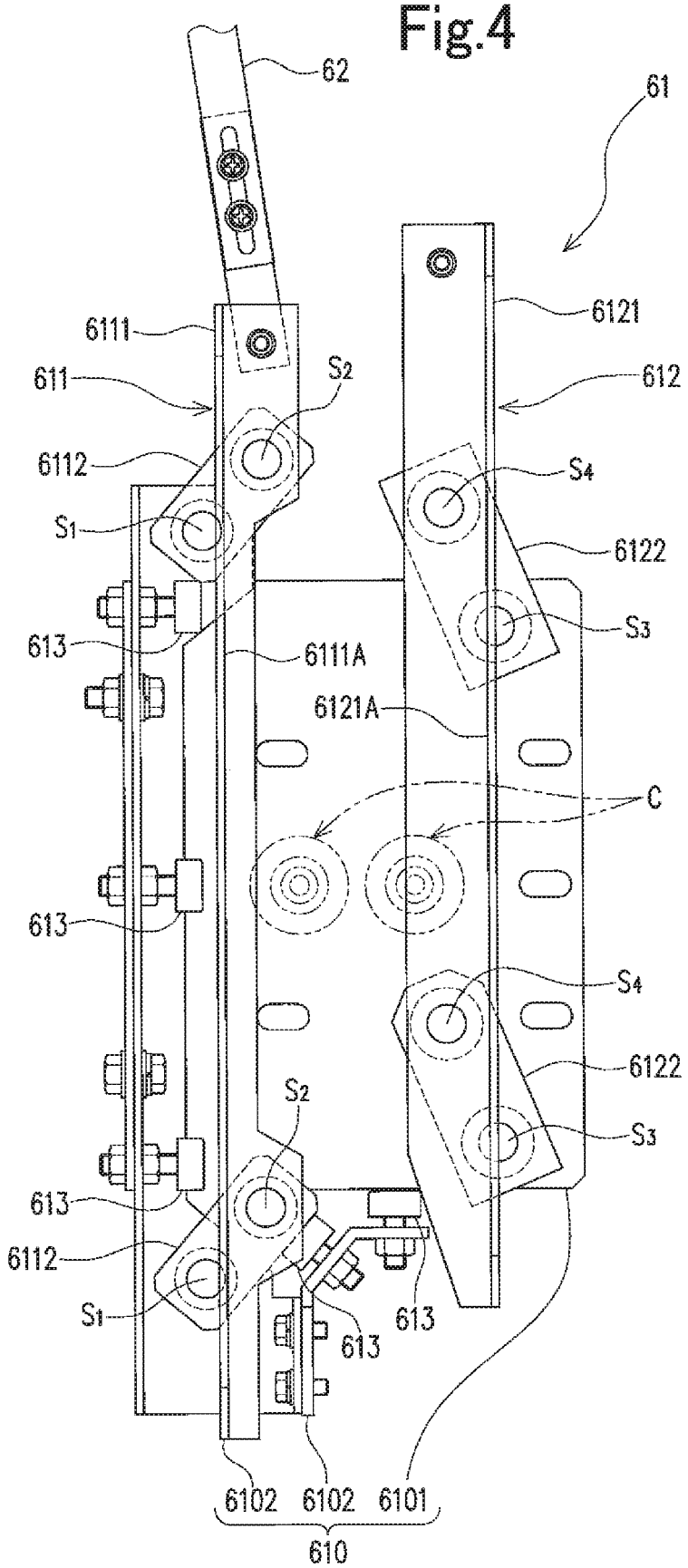
FIG. 4 is an explanatory diagram for the configuration of a first transmission part of the engaging part with catch rollers not held therein.
Figure 5:
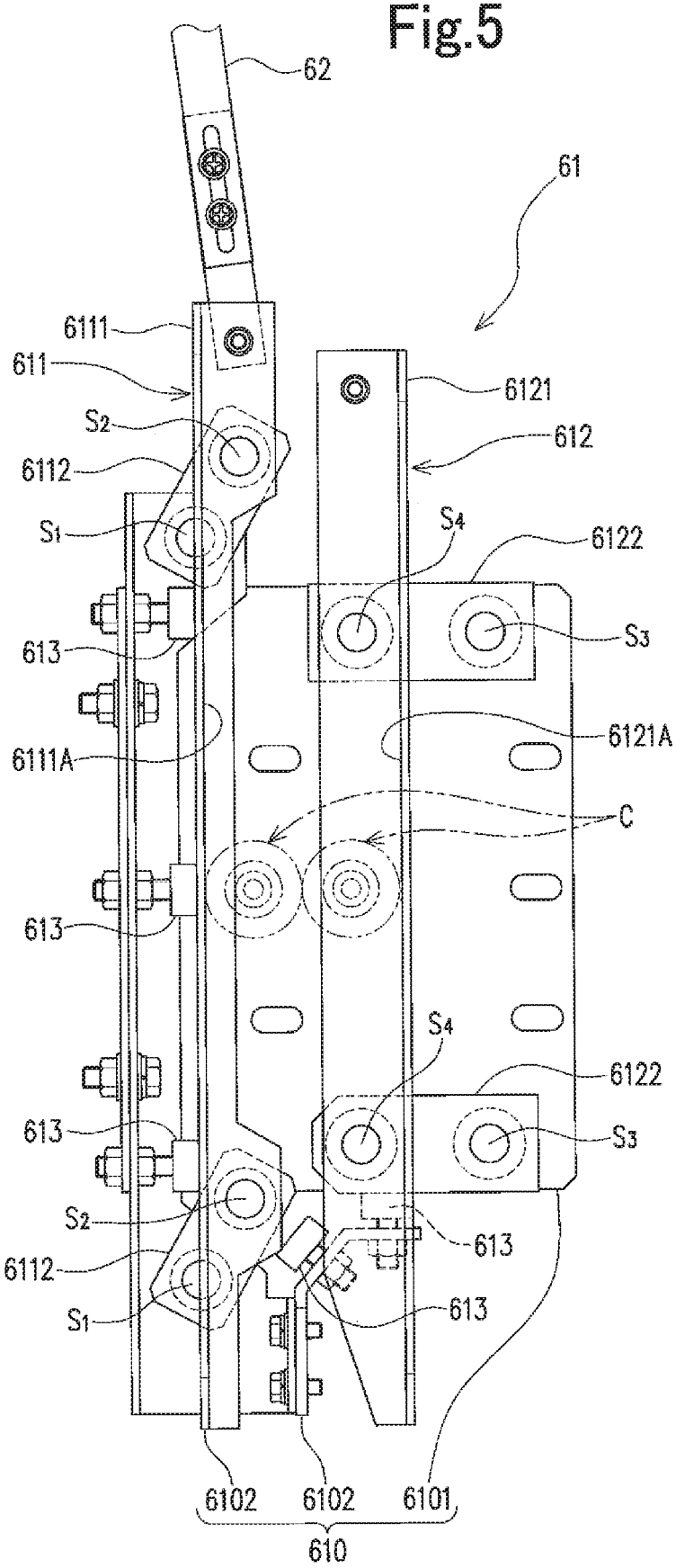
FIG. 5 is an explanatory diagram for the configuration of the first transmission part of the engaging part with the catch rollers held therein.

When the angle members (the first angle member 6111, the second angle member 6121) rotationally move, the restricting member 613 abuts on the angle members 6111, 6112 or the connecting members (the first connecting member 6112, the second connecting member 6122) to thereby restrict the angle members 6111, 6112 from further rotationally moving (see FIG. 4 and FIG. 5). In the first transmission part 61 of this embodiment, a plurality of restricting members 613 are held at predetermined positions by the holding part 6102 of the base 610.

The second transmission part 62 transmits the power of the driving device 3 to the engaging body 63 by the connection of the first transmission part 61 (specifically, the first angle member 6111) with the engaging body 63. Specifically, the second transmission part 62 extends from the upper end of the first angle member 6111 to the engaging body 63 disposed above the first angle member 6111. The second transmission part 62 of this embodiment has one end connected to the upper end of the first angle member 6111 to be relatively rotatable, and another end connected to the engaging body 63 to be relatively rotatable. The second transmission part 62 transmits the rotational motion (vertical motion) of the first angle member 6111 to the engaging body 63. The second transmission part 62 of this embodiment is formed by two elongated members connected together, and can be adjusted in length by increasing or decreasing the overlap amount (i.e., the overlap length) between these two members.

Figure 6:
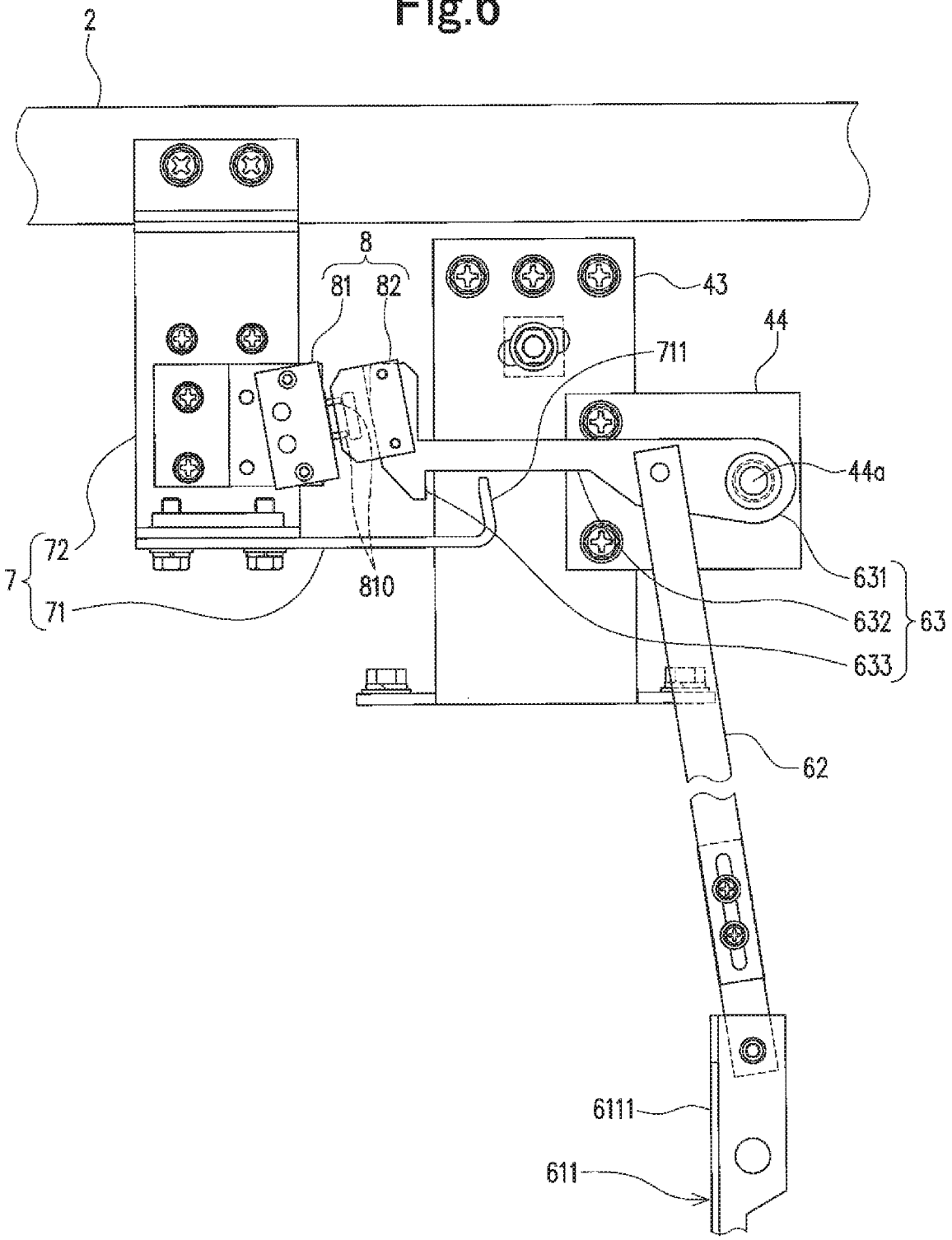
FIG. 6 is an explanatory diagram for the configuration of a second transmission part of the engaging part with the engaged body engaged with an engaging body.
Figure 7:
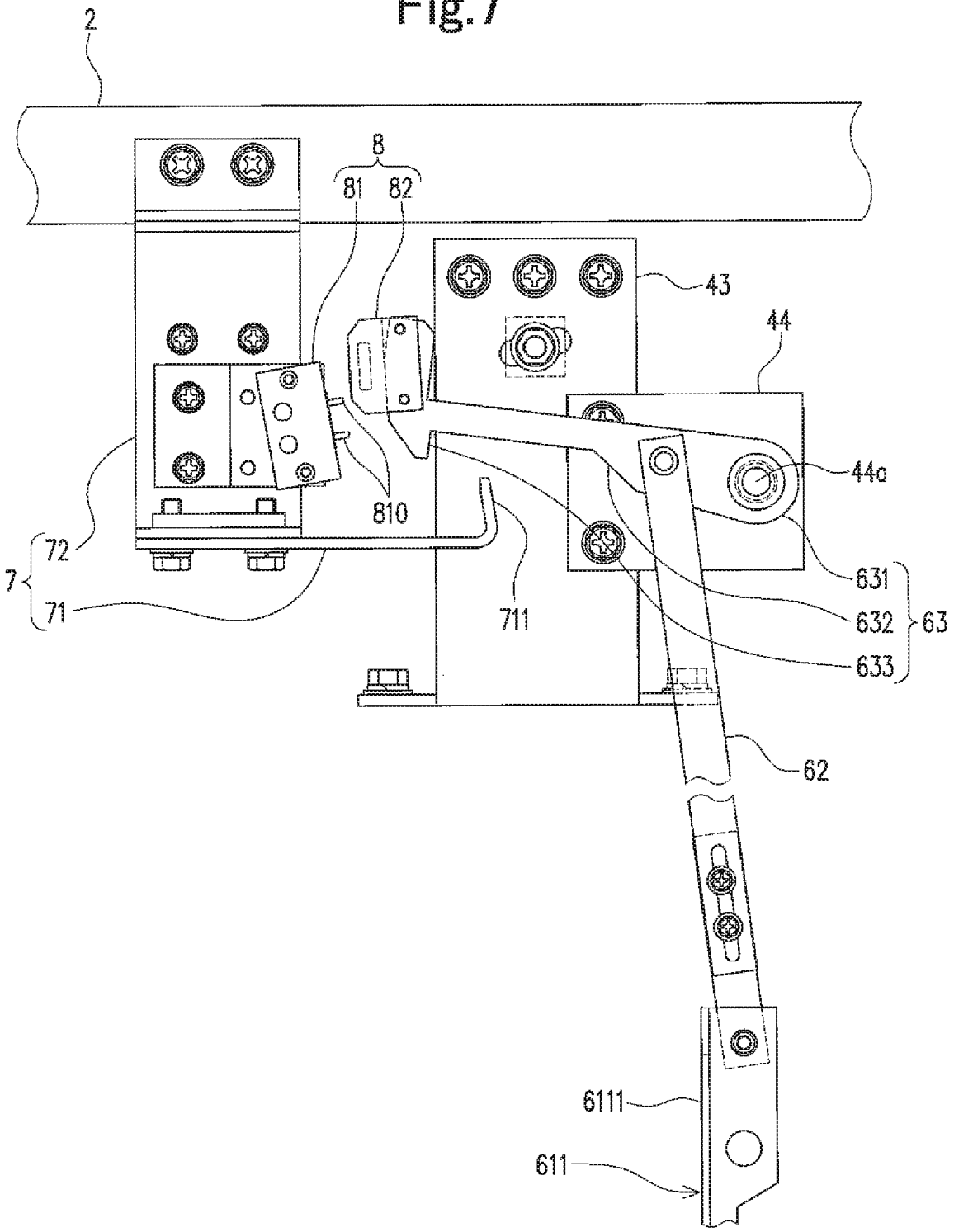
FIG. 7 is an explanatory diagram for the configuration of the second transmission part of the engaging part and the engaged part with the engaged body released from the engagement with the engaging body.

The engaging body 63 is disposed on the plate-shaped member 44 attached to the connecting member 43 to be rotationally movable. Specifically, the engaging body 63 includes a base 631 that is connected to a shaft 44*a* extending from the plate-shaped member 44 to be rotationally movable around the shaft 44*a*, an engaging body extending part 632 that extends from the base 631 and to which the second transmission part 62 is connected to be relatively rotatable, and a hook 633 that is disposed on a distal end (an end opposite to the base 631) of the engaging body extending part 632. The engaging body 63, which has been pushed upward by the second transmission part 62 upon the rotational motion of the first angle member 6111 (from the state shown in FIG. 4 to the state shown in FIG. 5), rotationally moves around the shaft 44*a* to come into the position (releasing position) out of engagement with the engaged body 71 (see FIG. 7). On the other hand, the engaging body 63, which has been pulled down by the transmission part 62 upon the rotational motion of the first angle member 6111 (from the state shown in FIG. 5 to the state shown in FIG. 4), rotationally moves around the shaft 44*a* (the opposite rotational motion to the rotational motion when coming into the releasing position) to come into the position (engaging position) in engagement with the engaged body 71 (see FIG. 6). In FIG. 6 and FIG. 7, the door 41 and the door hanger 42 are omitted for convenience of explanation.

Figure 8:
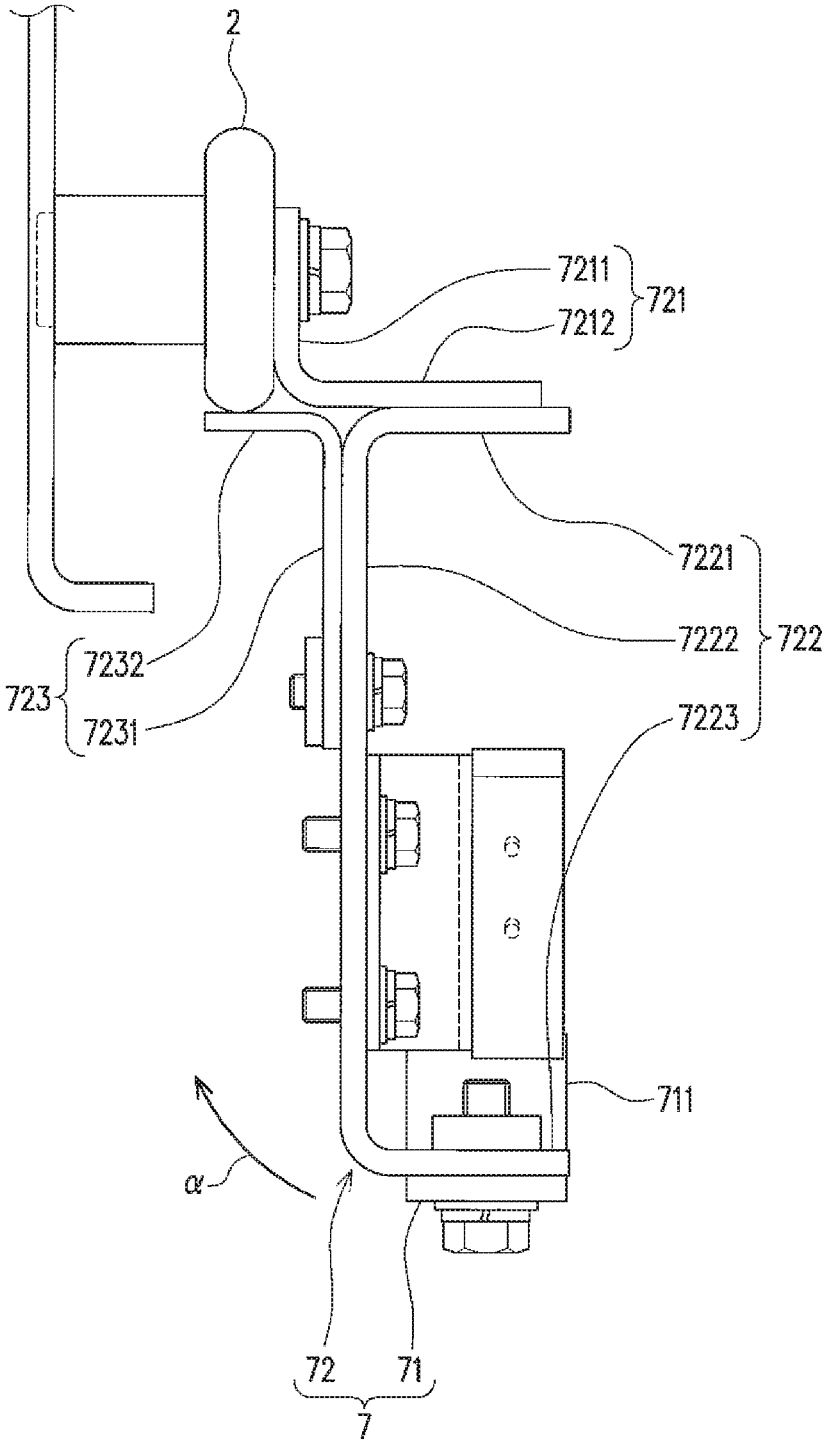
FIG. 8 is a view of the guide rail and the engaged part as seen in an opening and closing direction.

As shown in FIG. 8, the engaged part 7 includes the engaged body 71 that is disposed under the guide rail 2, a supporting part 72 that extends from the guide rail 2 to support the engaged body 71.

The supporting part 72 includes a first bracket 721 that is attached to the front surface of the guide rail 2 (the surface on the landing side), a second bracket 722 that downwardly extends from the first bracket 721, and a rotation stopping member 723 that prevents the second bracket 722 from rotating.

The first bracket 721 includes a first part 7211 that extends in the plan direction including the vertical direction and the opening and closing direction, and a second part 7212 that extends from the lower end of the first part 7211 to the front side and extends in the horizontal direction. That is, the first bracket 721 is a member having an L-shape in the cross section.

The second bracket 722 includes the first part 7221 that extends along the second part 7212 of the first bracket 721 and is connected (coupled) to the second part 7212, a second part 7222 that downwardly extends from the end part of the first part 7221 on the car side (the end part on the opposite side to the landing floor) and extends in the plane direction including the vertical direction and the opening and closing direction, and a third part 7223 that extends from the lower end of the second part 7222 to the front side and extends in the horizontal direction. That is, the second bracket 722 is a member having a U-shape in the cross section (the cross section in the plane direction including the vertical direction and the entrance direction). The engaged body 71 is connected to the lower end (the third part 7223) of the second bracket 722.

The rotation stopping member 723 is a member attached to the second bracket 722 on the car side (the opposite side to the landing floor). The rotation stopping member 723 is configured to prevent the second part 7222 from being warped or bent with a boundary point between the first part 7221 and the second part 7222 of the second bracket 722 as a base point or prevent the engaged body 71 from rotating around the boundary point to move to the car side (see the arrow a in FIG. 7), when a force has been applied to the engaged body 71 connected to the lower end of the second bracket 722. Specifically, the rotation stopping member 723 includes a first part 7231 that extends in the plane direction including the vertical direction and the opening and closing direction, and a second part 7232 that extends from the upper end of the first part 7231 to the side opposite to the front side and extends in the horizontal direction. That is, the rotation stopping member 723 is a member having an L-shape in the cross section. The second part 7232 of the rotation stopping member 723 abuts on the lower end of the guide rail 2.

The engaged body 71 is a plate-shaped member extending from the third part 7223 of the second bracket 722 in the opening and closing direction and has the bent distal end 711. The distal end 711 is engaged with the engaging body 63 (hook 633) at the engaging position.

The detecting part 8 includes a switch 81 that is disposed on the second bracket 722 of the supporting part 72, and a contact 82 that is disposed on the hook 633 of the engaging body 63. The switch 81 has two contacts 810 and is configured to detect that the opening and closing part 4 is held locked by the conduction of the two contacts 810. The contact 82 is disposed at such a position as to contact the two contacts 810 of the switch 81 (enable the conduction between the two contacts 810) when the engaging body 63 is at the engaging position.

The opening and closing part of the door device 1 configured as mentioned above opens and closes in association with the door on the landing floor side. A specific description will be given below.

When the car is raised or lowered within the shaft 11 to stop at a landing hall of a desired floor, the catch rollers C provided on the landing door enters between the pair of holding parts 611, 612 of the first transmission part 61, i.e., between the first holding surface 6111A and the second holding surface 6121A from the above or below (see FIG. 4).

Subsequently, the driving device 3 drives the door hangers 42 to respectively move the doors 41, which hang down from the door hangers 42, from the fully-closed position in the door opening direction. At this time, the first angle member 6111 of the pair of holding parts 611, 612 abuts on the catch rollers C, and then the door 41 moves in the door opening direction, so that the first angle member 6111 is pushed by the catch rollers C to thereby rotationally move until it abuts on the restricting member 613 (see FIG. 5). This rotational motion of the first angle member 6111 allows the engaging body 63 (i.e., the engaging body extending part 632) to be pushed upward to the second transmission part 62. Thereby, the engaging body 63 rotationally moves around the shaft 44*a* to lift the hook up to come into the releasing position to thereby release the engaged body 71 from the engagement with the engaging body 63 (see FIG. 7).

In this state, when the doors 41 respectively move in the door opening direction, the catch rollers C are pushed by the first angle member 6111 (the first holding surface 6111A) in the door opening direction, while being held between the pair of holding parts 611, 612 (specifically, the first angle member 6111 and the second angle member 6121), so that the landing doors open subsequent to the opening of the doors 41 of the car 12.

On the other hand, when the doors are closed, the driving device 3 drives the door hangers 42 to respectively move the doors 41, which hang down from the door hangers 42, from the fully-opened position in the door closing direction. At this time, the catch rollers C are pushed by the second angle member 6121 (the second holding surface 6121A) in the door closing direction, while being held between the pair of the holding parts 611, 612, so that the landing doors close subsequent to the closing of the doors 41 of the car 12.

When the doors 41 move to the fully-closed position, the catch rollers C are released from the held state by the pair of holding parts 611, 612. That is, the first angle member 6111 and the second angle member 6121 rotationally move to have an increased space therebetween in the opening and closing direction (see FIG. 4). This rotational motion of the first angle member 6111 allows the engaging body 63 (i.e., the engaging body extending part 632) to be pulled down to the second transmission part 62. Thereby, the engaging body 63 rotationally moves around the shaft 44*a* to pull the hook down and thereby comes into the engaging position to engage with the engaged body 71. That is, the locking mechanism 5 is locked to lock the opening and closing parts 4 (see FIG. 7).

When the locking mechanism 5 is locked, that is, the engaging body 63 comes into the engaging position, the contact 82 disposed on the engaging body enables conduction between the two contacts 810 of the switch 81, and hence enables the detecting part 8 to detect that the opening and closing parts 4 have been locked by the locking mechanism 5. After the detection is made, the car 12 can be raised or lowered.

According to the aforementioned door device 1, at least part of the engaged part 7 (i.e., the rotation stopping member 723 in this embodiment) is located in the area under the guide rail 2 (the area at which the at least part of the engaged part 7 overlaps with the guide rail 2 as seen in plan view). Therefore, the projection amount from the car toward the landing floor or from the landing floor toward the car can be reduced compared with the case where all the components of the locking mechanism 5 are disposed on the front side of the guide rail 2.

The elevator door device according to the present invention is not limited to the aforementioned embodiments, and it is a matter of course that various modifications can be made without departing from the gist of the present invention. For example, the configuration of a particular embodiment can be added to the configuration of another embodiment, and a part of the configuration of a particular embodiment can be replaced with the configuration of another embodiment. In addition, a part of the configuration of a particular embodiment can be eliminated.

In the elevator 10 of the aforementioned embodiment, the door device 1 is disposed in the car 12 and the catch rollers C are disposed in the landing door, but are not limited to this configuration. The door device 1 may be disposed in the landing floor and the catch rollers C may be disposed in the door 41 of the car 12.

In the elevator door device 1 of the aforementioned embodiment, the door 41 hangs down from the door hanger 42 via the connecting member 43, but is not limited to this configuration, provided that the opening and closing parts 4 have such a shape as to be openable and closable without abutting on the engaged part 7. For example, it may be configured so that the door 41 directly hangs down from the door hanger 42, specifically, the door hanger 42 and the connecting member 43 are integrated together, or the door 41 and the connecting member 43 are integrated together. In this case, when the door 41 or the door hanger 42 has a shape partly cut out, the opening and closing parts 4 are configured to have a shape so as to be openable and closable without abutting on the engaged part 7.

In the elevator door device 1 of the aforementioned embodiment, only the rotation stopping member 723 of the engaged part 7 is located in the area under the guide rail 2 (the area at which the engaged part 7 overlaps with the guide rail 2 in plan view), but the other part of the engaged part 7 may be disposed in this area.

In the elevator door device 1 of the aforementioned embodiment, the door 41 and the door hanger 42 are connected to each other by the two connecting members 43, but are not limited to this configuration. The door 41 and the door hanger 42 may be connected to each other by one connecting member 43 or three or more connecting members 43.

Although the elevator door device of this embodiment is as described above, the present invention is not limited to the aforementioned embodiment and the design may be appropriately changed within the scope where the present invention is intended. Also, the functional effect of the present invention is not limited to the aforementioned embodiment. That is, the embodiments disclosed herein should be assumed as not limitations but exemplifications in all aspects. The scope of the present invention is described not by the above description but by the claims. Further, the scope of the present invention is intended to include the scope equivalent to the claims and all the changes in the claims.

The invention claimed is:

1. An elevator door device comprising:

a rail that is disposed above a car entrance or a landing entrance and extends in a width direction of the entrance;

an opening and closing part that comprises a door, and a door hanger that allows the door to reciprocate along the rail while allowing the door to directly or indirectly hang down therefrom, and that opens and closes the entrance; and a locking mechanism that locks the opening and closing part, the locking mechanism comprising:

an engaging part that comprises an engaging body that changes its position between a releasing position and an engaging position in association with the opening and closing of the opening and closing part; and an engaged part that comprises an engaged body configured to be engaged with the engaging body that has come into the engaging position by the closing of the opening and closing part, wherein at least part of the engaged part is disposed in an area between the rail and an upper end of the entrance, and overlaps with the rail as seen in plan view in the area, wherein the opening and closing part has such a shape as to be able to open and close without abutting on the at least part of the engaged part located in the area, wherein the engaged part comprises a supporting member that extends from a front side of the rail to the engaged body and supports the engaged body, and a rotation stopping member that prevents rotation of the supporting member, wherein the supporting member comprises a plate-shaped part located between a point to which the rail is connected and a point to which the engaged body is connected, the plate-shaped part extending downward and expanding in a plane direction defined by a vertical direction and the width direction, and wherein the rotation stopping member comprises:

a first part that is attached to a rear side of the plate-shaped part of the supporting member on a side close to the rail; and a second part that extends from the first part toward the rail and abuts on the lower end of the rail, wherein a part of the engaged part is the second part.

2. The elevator door device according to claim 1, wherein the opening and closing part comprises two opening and closing parts that are disposed to be able to move toward and away from each other in the width direction, each of the two opening and closing parts comprises a connecting member disposed between the door and the door hanger to connect the door with the door hanger, and the at least part of the engaged part in the area is located between the connecting members of the two opening and closing parts.

3. The elevator door device according to claim 1, wherein the engaged body is disposed under the rail.

4. The elevator door device according to claim 1, wherein the engaged body extends in the opening and closing direction of the opening and closing part, and has a distal end bent upward to be engageable with the engaging part.

* * * * *